US006574810B2

(12) United States Patent
Mangiaracina

(10) Patent No.: US 6,574,810 B2
(45) Date of Patent: Jun. 10, 2003

(54) INFANT SEAT

(76) Inventor: Anita J. Mangiaracina, 89 Treadwell Rd., Binghamton, NY (US) 13905

( * ) Notice: Subject to any disclaimer, the term of this patent is extended or adjusted under 35 U.S.C. 154(b) by 99 days.

(21) Appl. No.: 09/775,984

(22) Filed: Feb. 2, 2001

(65) Prior Publication Data

US 2002/0104166 A1 Aug. 8, 2002

(51) Int. Cl.[7] ..... A47D 13/06

(52) U.S. Cl. ..... 5/655; 5/94; 5/922; 119/28.5; 297/452.16; D6/333; D30/118

(58) Field of Search ..... 5/655, 420, 732, 5/636, 945, 946, 94; 119/28.5; 297/452.16; D6/333; D30/118

(56) References Cited

U.S. PATENT DOCUMENTS

| | | | | | |
|---|---|---|---|---|---|
| 690,914 | A | * | 1/1902 | Bentley | |
| 2,128,978 | A | * | 9/1938 | Akin | 5/946 |
| 3,279,849 | A | | 10/1966 | Radke | 297/284 |
| 3,423,127 | A | * | 1/1969 | Shankman | 5/420 |
| 3,493,228 | A | * | 2/1970 | Hicks et al. | 5/655 |
| 3,537,116 | A | * | 11/1970 | Kain | 5/420 |
| 3,840,916 | A | | 10/1974 | Jennings | |
| 3,911,512 | A | | 10/1975 | Plate | |
| 4,047,757 | A | | 9/1977 | Eames et al. | 297/230 |
| 4,441,221 | A | | 4/1984 | Enste et al. | |
| 4,500,129 | A | * | 2/1985 | Hahn | 5/420 |
| 4,538,310 | A | | 9/1985 | Scott | |
| 4,670,923 | A | * | 6/1987 | Gabriel et al. | 5/655 |
| D302,360 | S | | 7/1989 | Riehm | D6/333 |
| 4,871,210 | A | | 10/1989 | Alexander et al. | 297/435 |
| 4,909,573 | A | | 3/1990 | Barry et al. | 297/456 |
| 5,193,238 | A | | 3/1993 | Clute | 5/655 |
| 5,347,669 | A | | 9/1994 | Neviaser et al. | 5/655 |
| 5,351,348 | A | * | 10/1994 | Beger | 5/420 |
| 5,367,730 | A | | 11/1994 | Sher | 5/655 |
| 5,437,070 | A | | 8/1995 | Rempp | 5/636 |
| 5,473,785 | A | * | 12/1995 | Lager et al. | 5/420 |
| 5,687,433 | A | | 11/1997 | Garner et al. | 4/572.1 |
| D397,575 | S | * | 9/1998 | Miller | D6/601 |
| 5,930,854 | A | * | 8/1999 | O'Neill et al. | 5/655 |
| 5,996,153 | A | | 12/1999 | Slater et al. | 5/655 |
| 6,000,761 | A | | 12/1999 | Rocha | 297/464 |
| 6,049,929 | A | | 4/2000 | Rawson | 5/655 |
| 6,408,463 | B1 | * | 6/2002 | Palacio | 5/655 |

FOREIGN PATENT DOCUMENTS

| | | | | |
|---|---|---|---|---|
| DE | 3436807 | * | 3/1985 | 5/945 |
| DE | 4024807 | * | 2/1992 | 5/655 |
| DE | 4237792 | * | 5/1993 | 5/655 |
| GB | 2269741 | * | 2/1994 | 5/655 |

OTHER PUBLICATIONS

*One Step Ahead* Magazine, Spring 1994, p. 16, No. G.

* cited by examiner

*Primary Examiner*—Alexander Grosz
(74) *Attorney, Agent, or Firm*—Katherine McGuire

(57) ABSTRACT

A seat for supporting an infant which may be configured to resemble a flower. The seat may also be used as a pet bed. The seat includes a center portion upon which the infant is seated with one or more side supports extending outwardly therefrom to substantially surround the infant. The side supports may be configured to resemble the petals of a flower (e.g., a rose, a daisy, a black-eyed susan, a sunflower, etc.) with the center portion being the center part of the flower. The seat is especially useful for an infant that cannot yet support themselves in a sitting-up position by stopping them from fully tipping over in any direction.

18 Claims, 13 Drawing Sheets

INFANT SEAT

BACKGROUND OF THE INVENTION

The present invention relates to a seat for infants. More particularly, the present invention relates to an infant seating structure designed to be positioned upon a floor or other safe, flat support surface which provides a contained, structural support especially suited for an infant unable to support him/herself in a sitting up position on their own.

Various types of seating structures are known which are directed toward infants and small children that cannot yet support their own bodies in an upright position (e.g., sitting-up). These include seating designed to be attached to another object, for example a high chair or an adult chair (see, e.g., U.S. Pat. Nos. 4,871,210 and 5,996,153); seating designed to support a child in the bath (see, e.g., U.S. Pat. No. 5,687,433); and seating designed as a stand-alone seat to support a child in a seated position (see, e.g., U.S. Pat. Nos. 3,840,916; 6,000,761 and 6,049,929). Still other commonly known child seating structures include the so-called "walkers" and "saucers" where the child's legs are passed through openings in a suspended seat which is incorporated into a rigid support frame surrounding the child's torso.

While it is of course a main object of an infant seat to effectively support the infant in the intended position, it is also desirable to allow the infant a range of movement so that the infant may safely interact with his/her immediate surroundings to permit enhanced visual, touch and other motor stimulation for the infant. It is thus also desirable that the infant be able use and develop the muscles which contribute to the infant being able to balance themselves in a sitting up position. The seating structures of the prior art are typically very confining to the infant and thus do not provide an enhanced range of movement for the infant. The prior seating structures also typically lack features permitting adjustment of the seat to allow the infant to be placed in a variety of different support positions.

SUMMARY OF THE INVENTION

The present invention addresses the deficiencies of prior infant seating structures by providing, in a first aspect, an infant seat which provides multiple support features in a single seating system which allow the infant an enhanced range of movement within the seat while also providing upright support for the infant. The inventive seat is particularly suited for an infant that is not yet fully able to balance him/herself in a sitting-up position. At this stage of an infant's development (typically around the age of about 3 to about 6 months, although this of course may vary according to the particular individual), the infant may be seated in an upright position but usually immediately tips over. As physical development continues, the infant may stay sitting up anywhere from a few seconds to a minute or two, but usually eventually loses his/her balance and tips over. The infant can fall from the sitting-up position in any direction about a full 360° perimeter about the infant (i.e., the infant may tip forward, backward or sideways). Once the infant has lost its balance and fallen over, it usually cannot return to a sitting-up position without adult assistance. Thus, while an adult may wish for the infant to be able to practice sitting-up by themselves, they find that in order to do this, they must remain at the infant's side to help maintain the infant's balance and upright the infant when the infant falls over. The present invention successfully addresses this long-existing problem by providing an infant seat that functions to assist an infant in maintaining their balance while in a sitting-up position about a full 360° perimeter of the infant. Thus, should the infant begin to tip in any direction, their body will encounter and be supported by one or more of the side supports 16*a–d* so that they do not tip fully over. This encourages the infant to use his/her own body muscles to return to the sitting-up position. The inventive seat achieves this advantage without being overly restrictive to the infant's body movements directed toward play and learning about their surroundings (e.g., while reaching for a toy).

In a second aspect, the inventive seat with the above functional attributes may be made to resemble a flower or the like. The inventive seat is thus not only extremely effective at providing support for an infant in the sitting-up position as explained above, but also cleverly combines function and form by configuring the various elements thereof into a form which resembles practically any type of flower as desired (e.g., a rose, a daisy, a black-eyed susan, a sunflower, etc.). The seating structure may thus be made to resemble a flower with multiple side supports constructed to resemble the petals of the flower, the center of which representing the center of the flower. In the preferred embodiment, the seating structure is a "soft sculpture", meaning that it is made of fabric and is stuffed with a soft material such as polyester, for example. The "flower petals" comprising the side supports of the seating structure are preferably individually and continuously adjustable both inwardly toward the center (to provide a more upright, vertical support) and outwardly (to provide a more "laid back" support, approaching the horizontal position).

DETAILED DESCRIPTION

Figure 1:
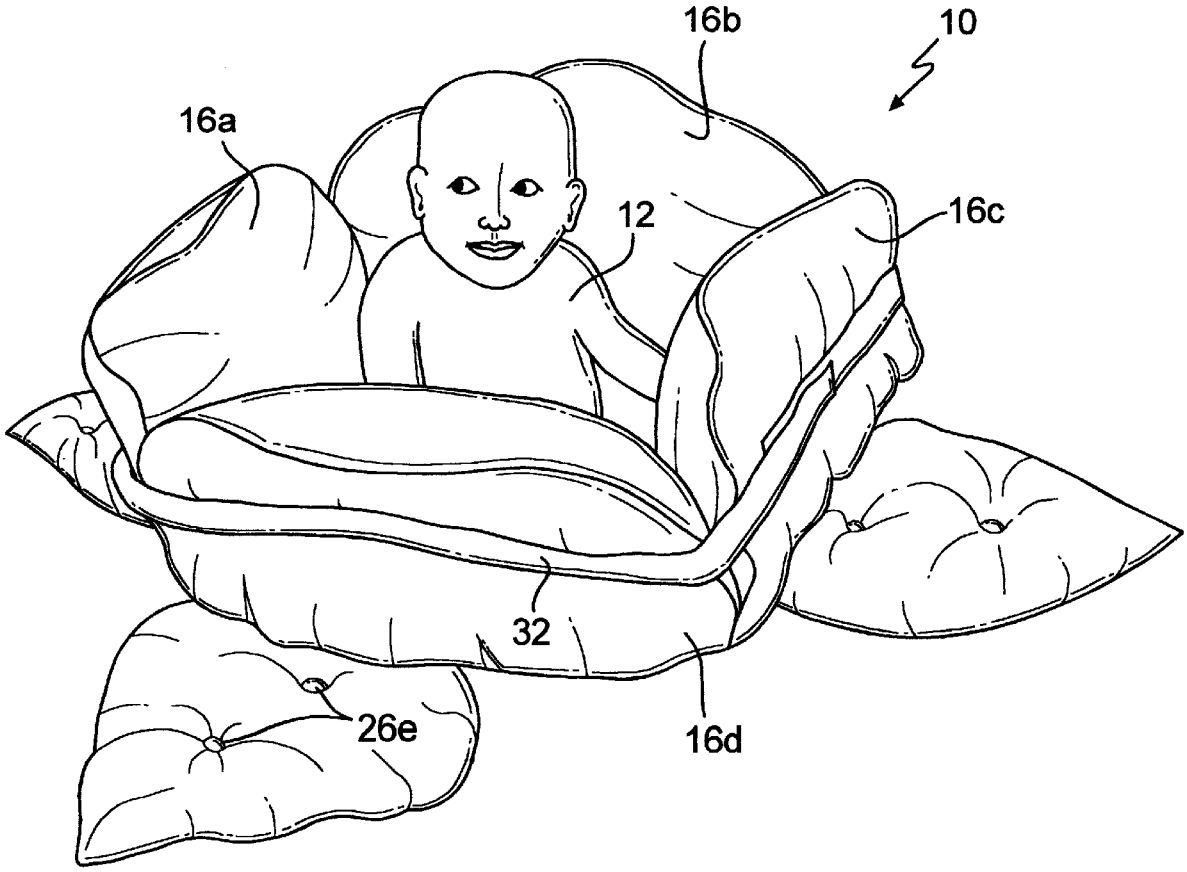
FIG. 1 is a perspective view of one embodiment of the inventive seat supporting an infant.
Figure 2:
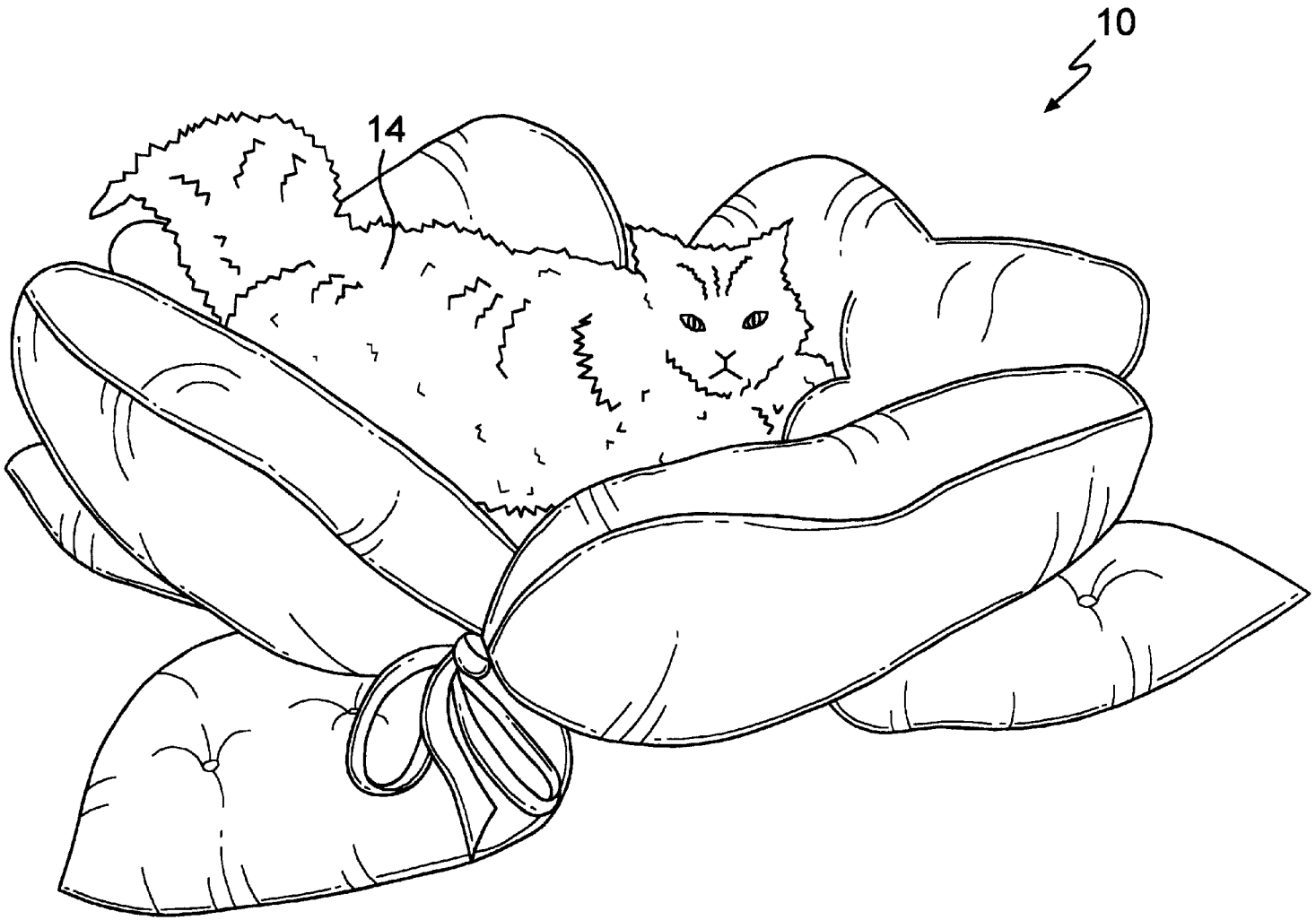
FIG. 2 is a perspective view of another embodiment of the inventive seat showing a cat seated therein to illustrate the alternate use of the seat as a pet bed.
Figure 7:
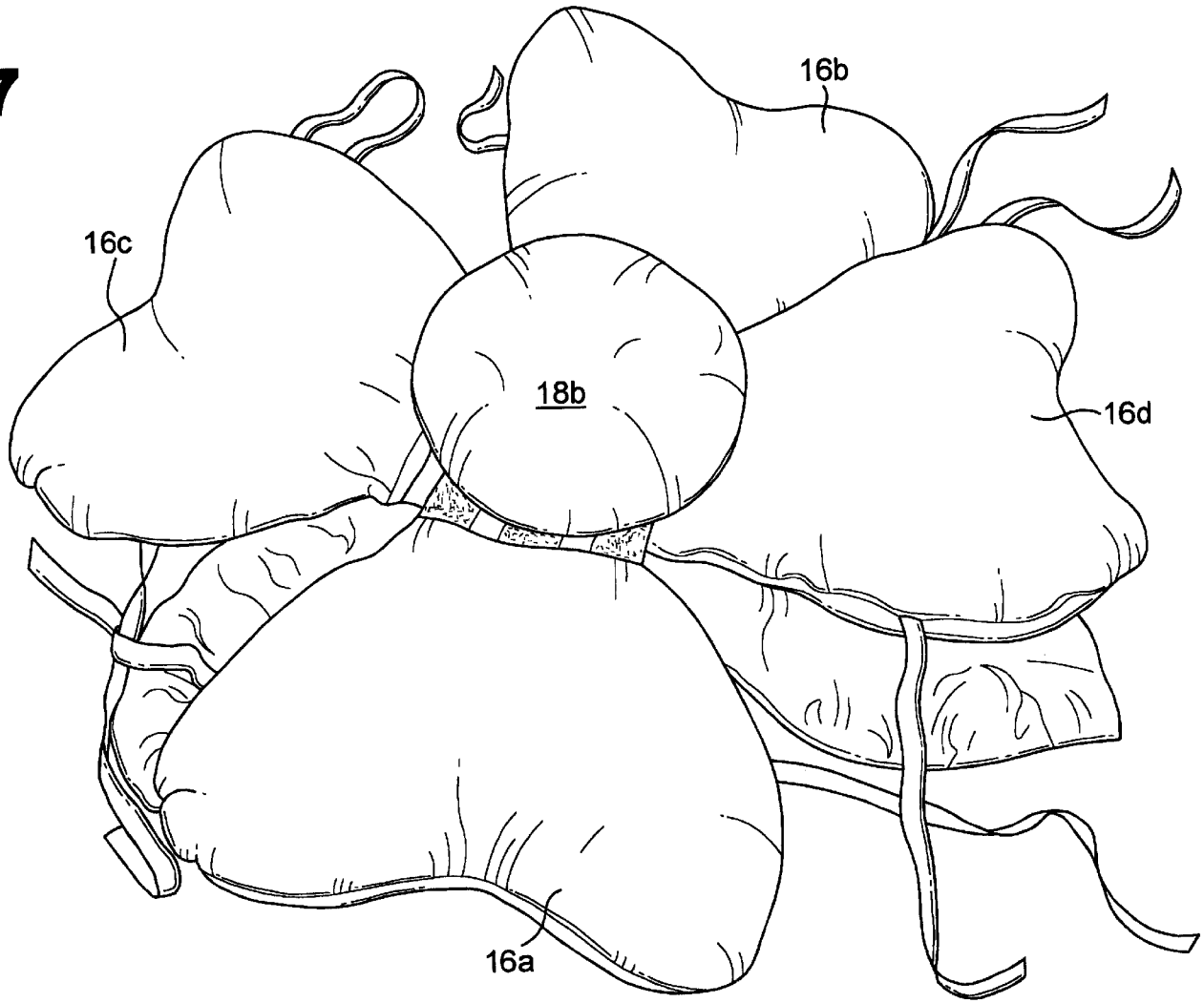
FIG. 7 is a top view of FIG. 6 and further showing fabric leaves attached to the seat base as an optional accessory.
Figure 8:
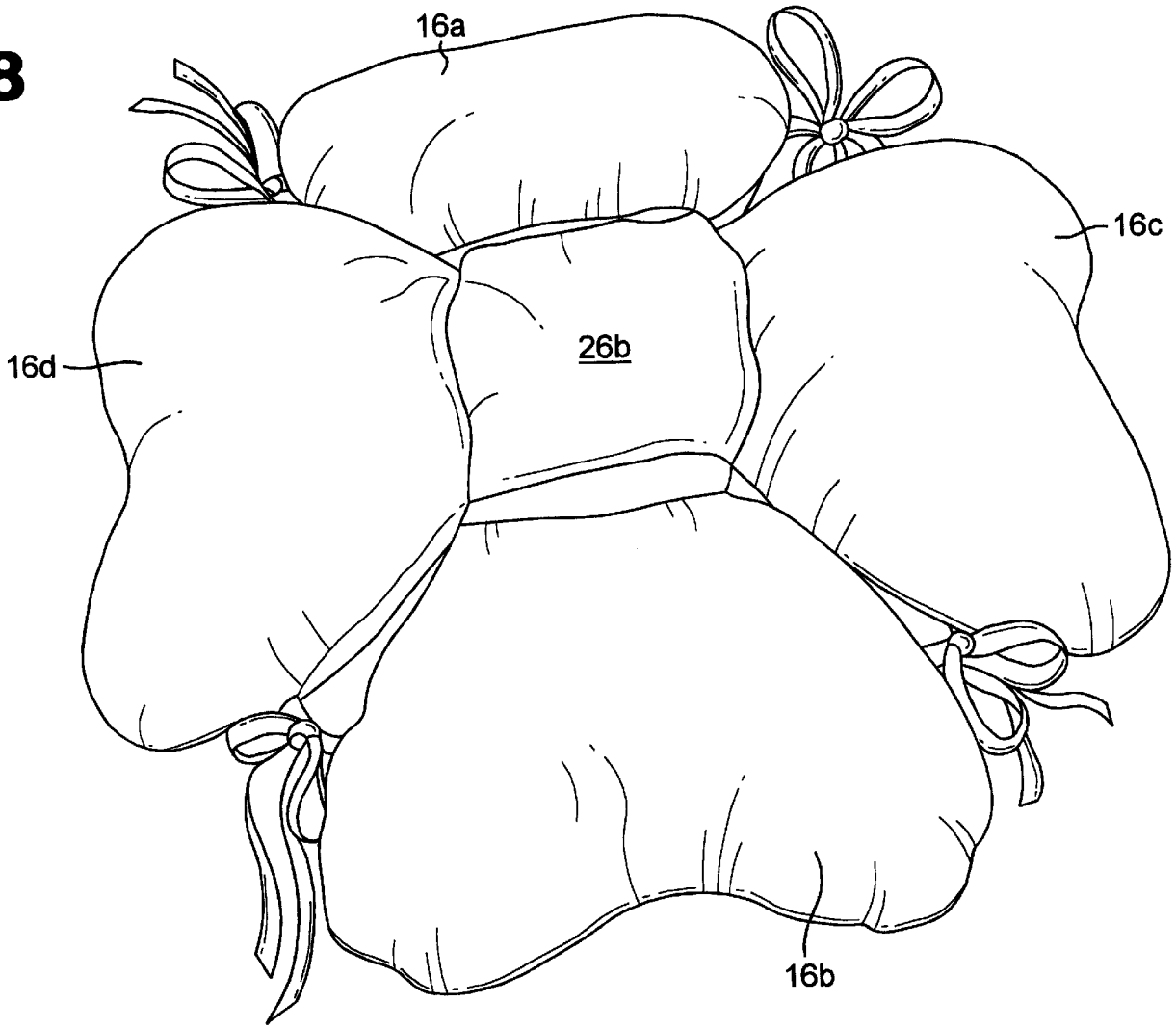
FIG. 8 is a bottom plan view of the seat.

Referring now to the drawing, there is seen in FIGS. 1 and 2 the inventive seat indicated generally by the reference numeral 10. In FIG. 1, an infant 12 is shown in the seat 10 while in FIG. 2, a cat 14 is shown in the seat 10 to illustrate the alternate use of seat 10 as a pet bed. In the preferred embodiment of the invention, seat 10 is made to resemble a flower as seen in the drawing figures, although it is envisioned that the seat may be made to resemble other objects, or no particular object other than a seat, if desired. Also, the overall shape of the seat may vary from substantially circular, as shown (e.g., rectangular, square, polygonal, triangular, etc.). The invention is thus not to be considered limited to the specific embodiments shown in the drawing, but rather be considered as taking any form consistent with the specification and claims hereof Thus, as seen in the drawing, seat 10 is made to resemble a flower which is aesthetically pleasing for an infant seat or pet bed. In particular, seat 10 includes at least one, but preferably a plurality of individually movable side supports 16*a*–16*d* which are intended to resemble the individual petals of a flower. A cushion or pillow 18 is provided at the center of the seat (see FIG. 7) upon which the infant's buttocks is seated with the back of the infant being able to rest against one or more of the side supports 16*a*–16*d* when necessary. As will be discussed in more detail below, side supports 16*a–d* are preferably independently movable and continuously adjustable from the horizontal to the vertical orientation with respect to the floor such that an adult may adjust the angle at which the infant is seated and supported in seat 10. For example, if it is desired to have the infant supported in an essentially upright position yet are not able to maintain their balance on their own, the side supports 16*a–d* are lifted upright to the vertical position seen in FIG. 1. If the infant can maintain their balance for at least a short time, it may be desirable to adjust the side supports outwardly toward a slightly more horizontal position. As such, the infant will be able to balance itself within the seat without the leaning on the side supports, yet should the infant begin to tip over, the side supports will stop the infant from fully tipping over so that it will be easier for them to regain their balance (and thus help strengthen the muscles to accomplish this movement). If it is desired to have the infant in a more laid-back position (e.g., a sleeping infant), the side supports 16*a–d* may be moved toward the floor until the desired amount of inclination is achieved. A more laid-back position of side supports 16*a–d* is seen in FIG. 2 which illustrates this also happens to be a good position for use of the seat as a pet bed.

Figure 3:
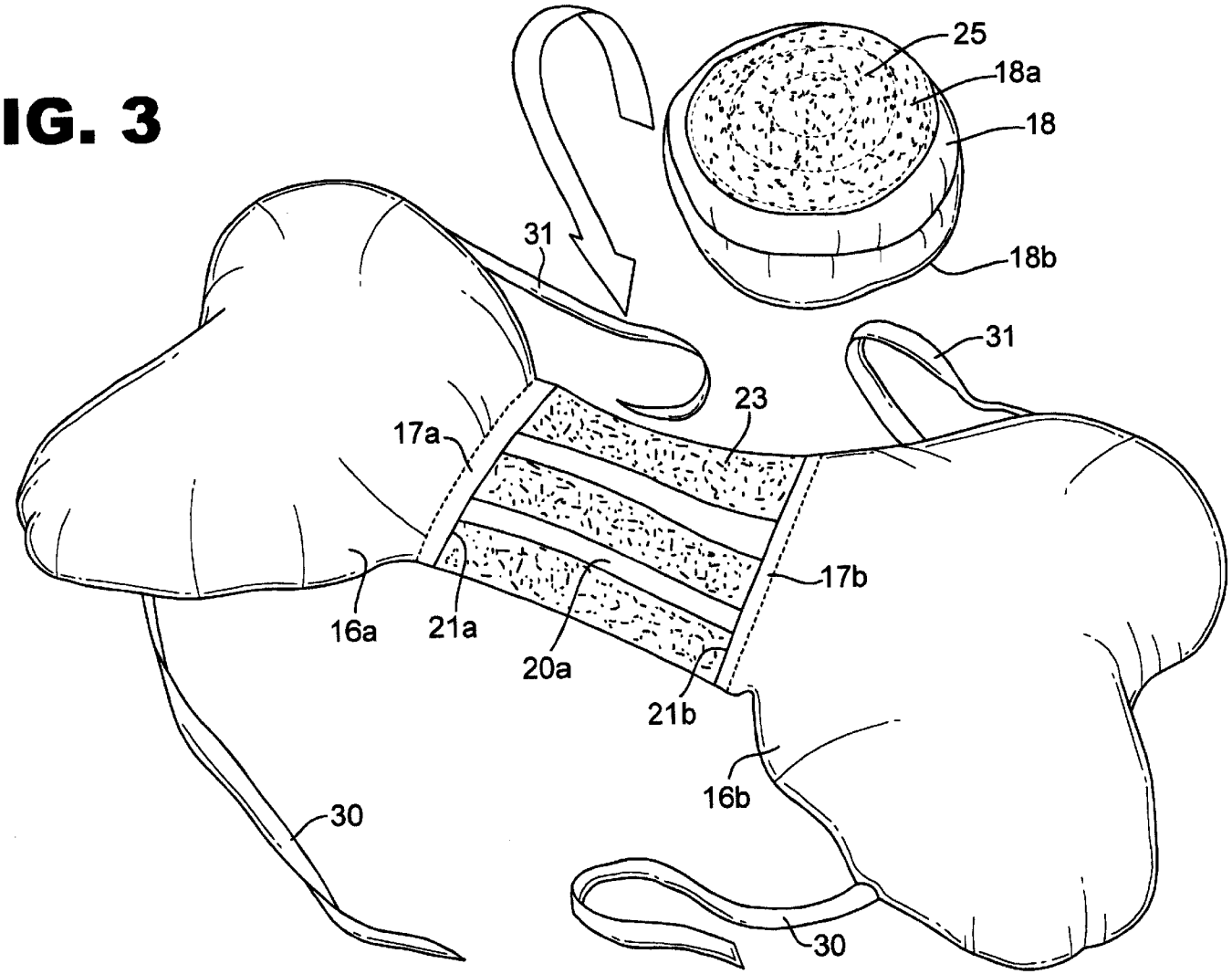
FIG. 3 is a top view of one petal pair showing the manner of attaching the center pillow thereto.
Figure 4:
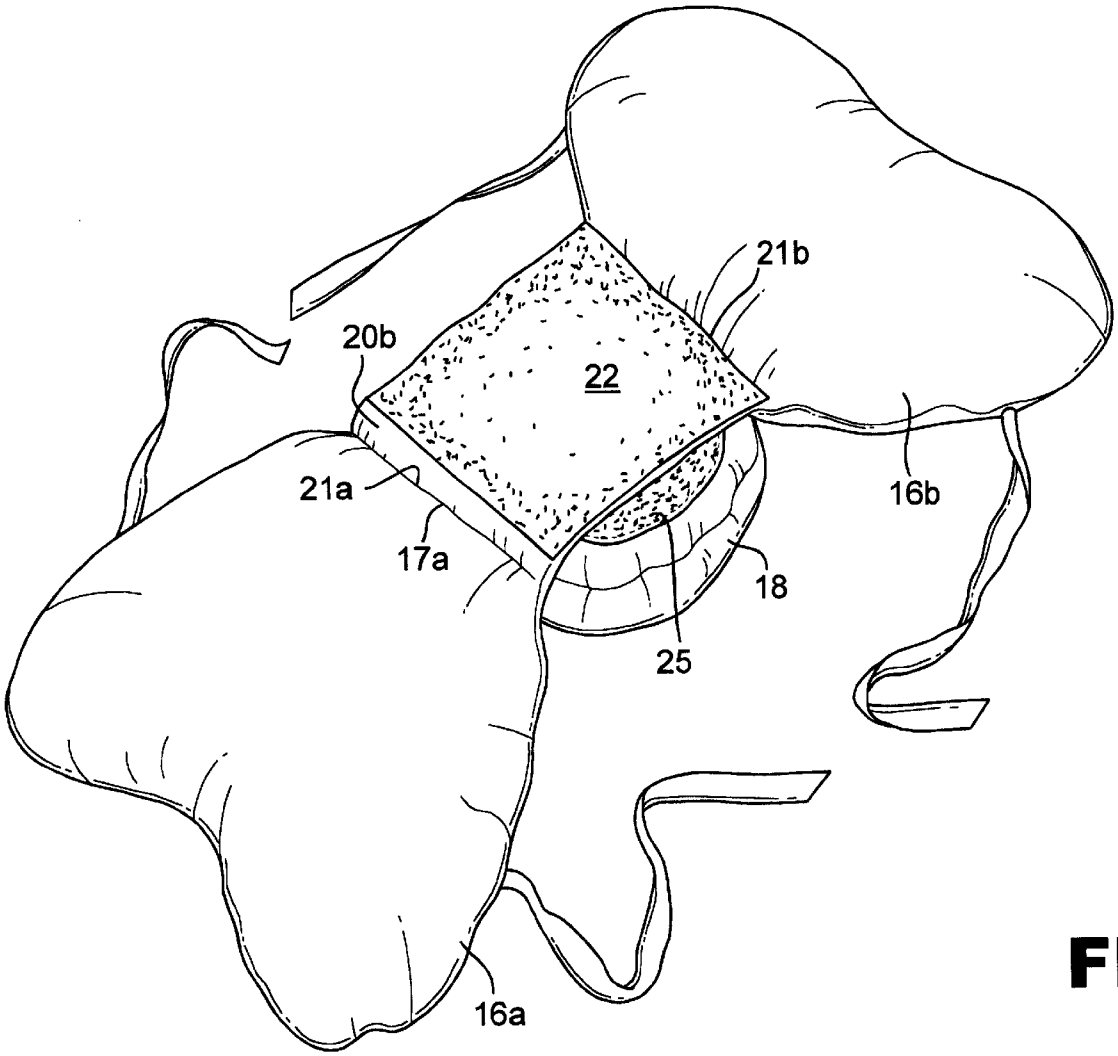
FIG. 4 is a bottom view of FIG. 3 showing the pillow in the attached condition.
Figure 5:
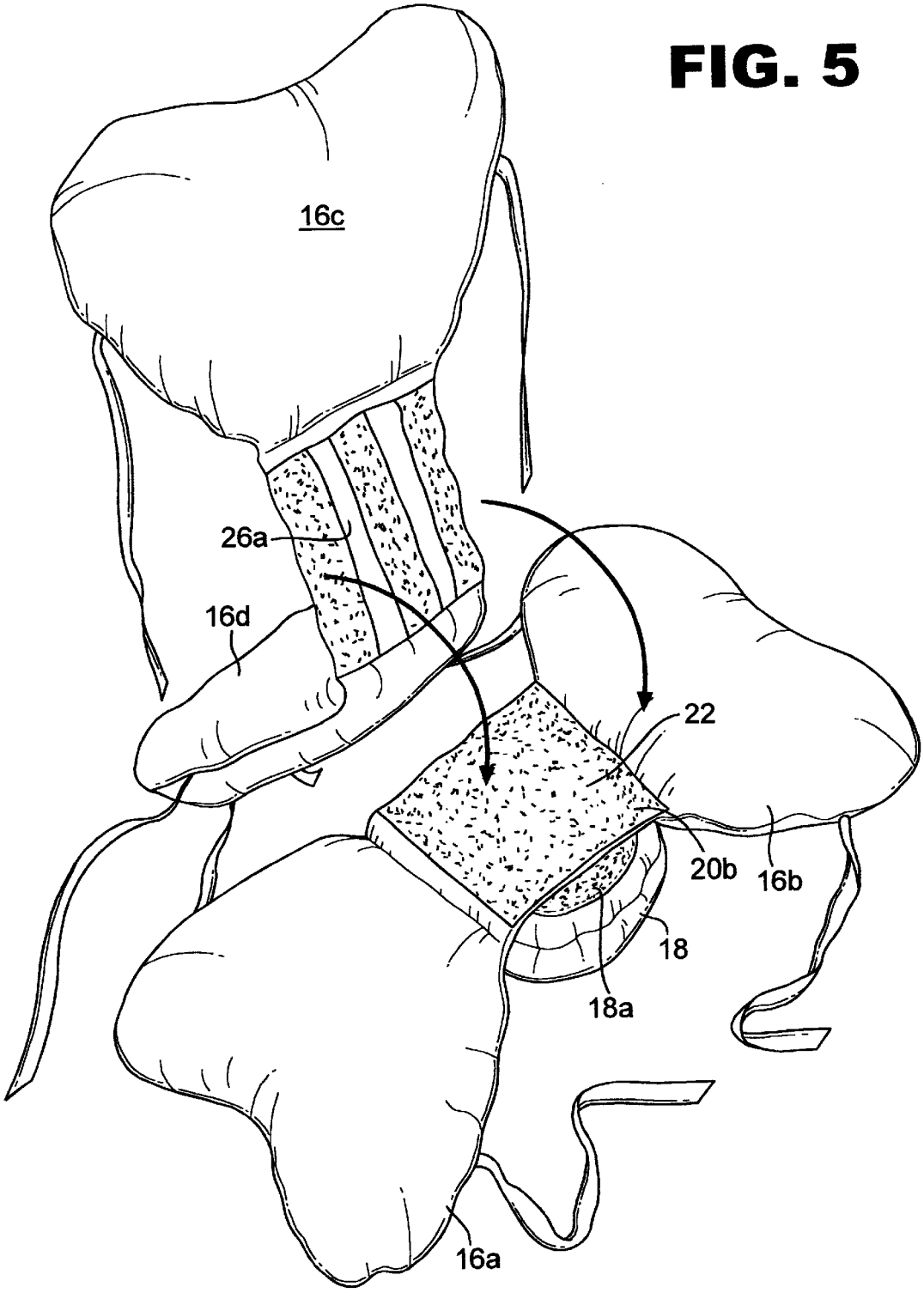
FIG. 5 is the view of FIG. 4 and further showing the manner of attaching a second petal pair to the first petal pair.

Referring now to FIGS. 3–5, the presently preferred method of making seat 10 will now be described. It is understood that other methods of manufacture are possible as will be appreciated particularly by those skilled in the art of textiles, upholstery, or infant seating design, for example. As previously mentioned, it is preferred that seat 10 be made as a soft sculpture to provide that maximum amount of comfort to the infant seated therein. In the embodiment shown and described herein, seat 10 has soft fabric coverings about at least those parts of seat 10 which will likely come into contact with the infant while seated therein. Thus, it is preferred that at least the side supports 16*a–d* and pillow 18 are encased by a soft fabric covering. To provide cushioning, side supports 16*a–d* and pillow 18 are filled with a soft material such as foam or polyester, for example.

Referring still to FIGS. 3–5, side supports 16*a–d* may be formed in two pairs 16*a,b* and 16*c,d,* respectively, which may be releasably attached to one another in the manner shown in FIG. 5 to form the completed seat 10. More particularly, side supports 16*a* and 16*b* are interconnected by a fabric section having upper and lower surfaces 20*a* and 20*b,* respectively, which may be sewn or otherwise attached at opposite edges 21*a*, 21*b* thereof to the base edges 17*a*, 17*b* of side supports 16*a*, 16*b*, respectively. Likewise, side supports 16*c* and 16*d* are interconnected by a fabric section having upper and lower surfaces 26*a* and 26*b*, respectively. Of course if desired, the fabric section may instead be formed integral with one or more of the side supports 16*a–d.*

Figure 6:
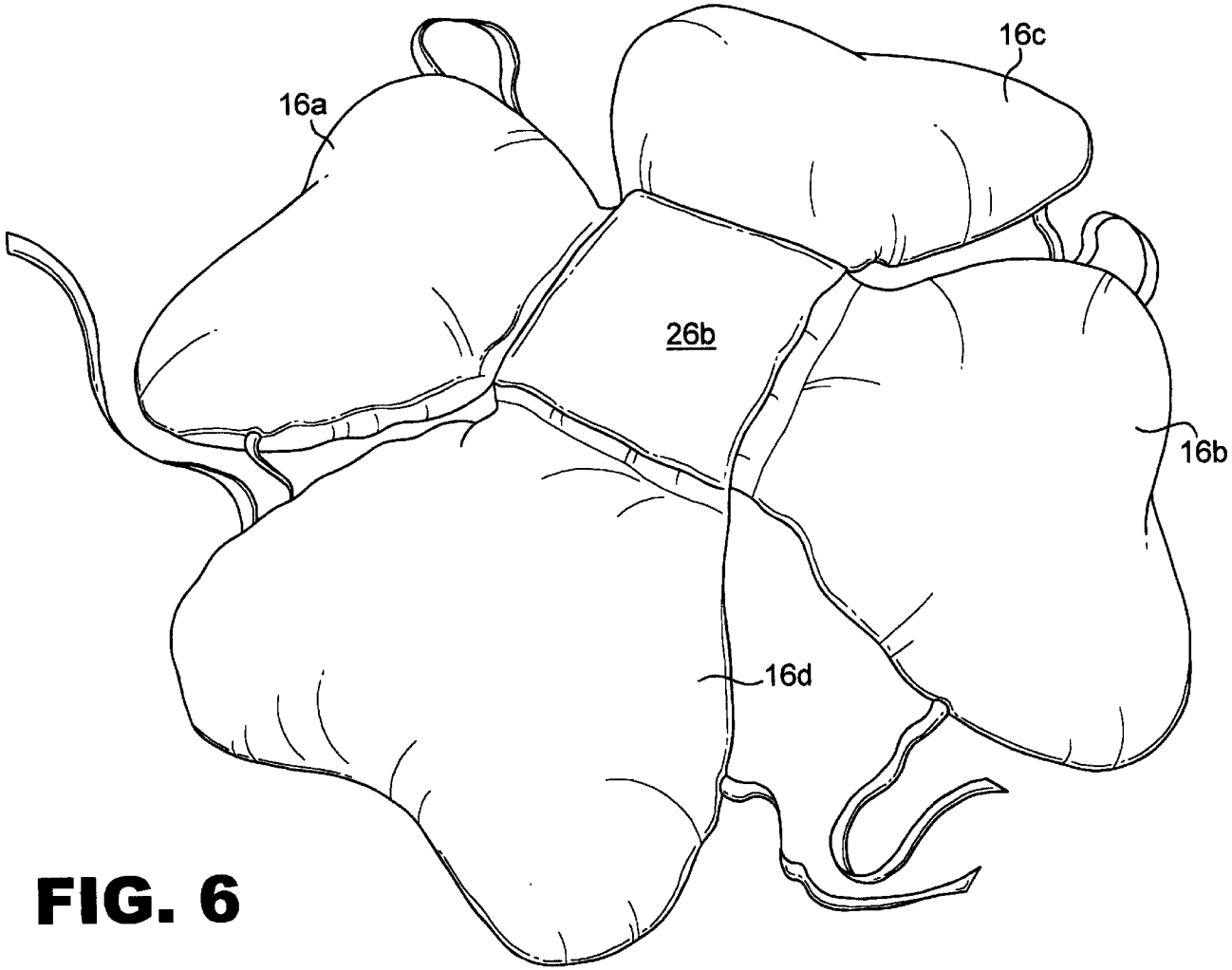
FIG. 6 is the view of FIG. 5 showing the first and second petal pairs in the attached condition.

As seen best in FIG. 5, mating VELCRO patches 22, 24 are fixed to the lower surface 20*b* of the fabric section between supports 16*a,* 16*b,* and to the upper surface 26*a* of the fabric section between side supports 16*c,d,* respectively, such that the side support pairs may be assembled together in a perpendicular orientation to one another. This arranges the side supports in an endless array as seen in FIG. 6 which is a bottom plan view of the assembled side supports. The term "endless array" as used herein means that the side supports are arranged to circumscribe a 360° perimeter regardless of the ultimate shape of the side support array (e.g., circular, square, rectangular, triangular, etc.). The assembled side supports are then turned over with lower surface 26*b* placed against the floor or other stable, safe support, to the position seen in FIG. 7 whereupon pillow 18 may be positioned at the juncture of the side supports 16*a–d.* It is preferred that pillow 18 is firmly yet removably attached to the side supports by using mating VELCRO patches 23 and 25 attached to the upwardly facing surface of patch 20*a* (i.e., the surface opposite VELCRO patch 22 on side support pair 16*a,* 16*b),* and what can be considered the "bottom" surface 18*a* of pillow 18. It is also understood that pillow 18 may be attached to the side support pair 16*a,* 16*b* before or after assembling pair 16*a,* 16*b* to side support pair 16*c*, 16*d.* This is evident from the drawing figures which show pillow 18 being attached to side supports 16*a,* 16*b* in FIG. 3 prior to assembling supports 16*a,* 16*b* to supports 16*c*, 16*d.* Pillow 18 or other cushioning material may also be formed integral with the side supports, if desired.

It is noted that manufacturing the seat in separate components as illustrated in the drawing and described herein is preferred to allow for outer fabric coverings for each element which may be easily removed, laundered and replaced when they are soiled. This is an important consideration in infant seating and pet bedding.

Figure 9:
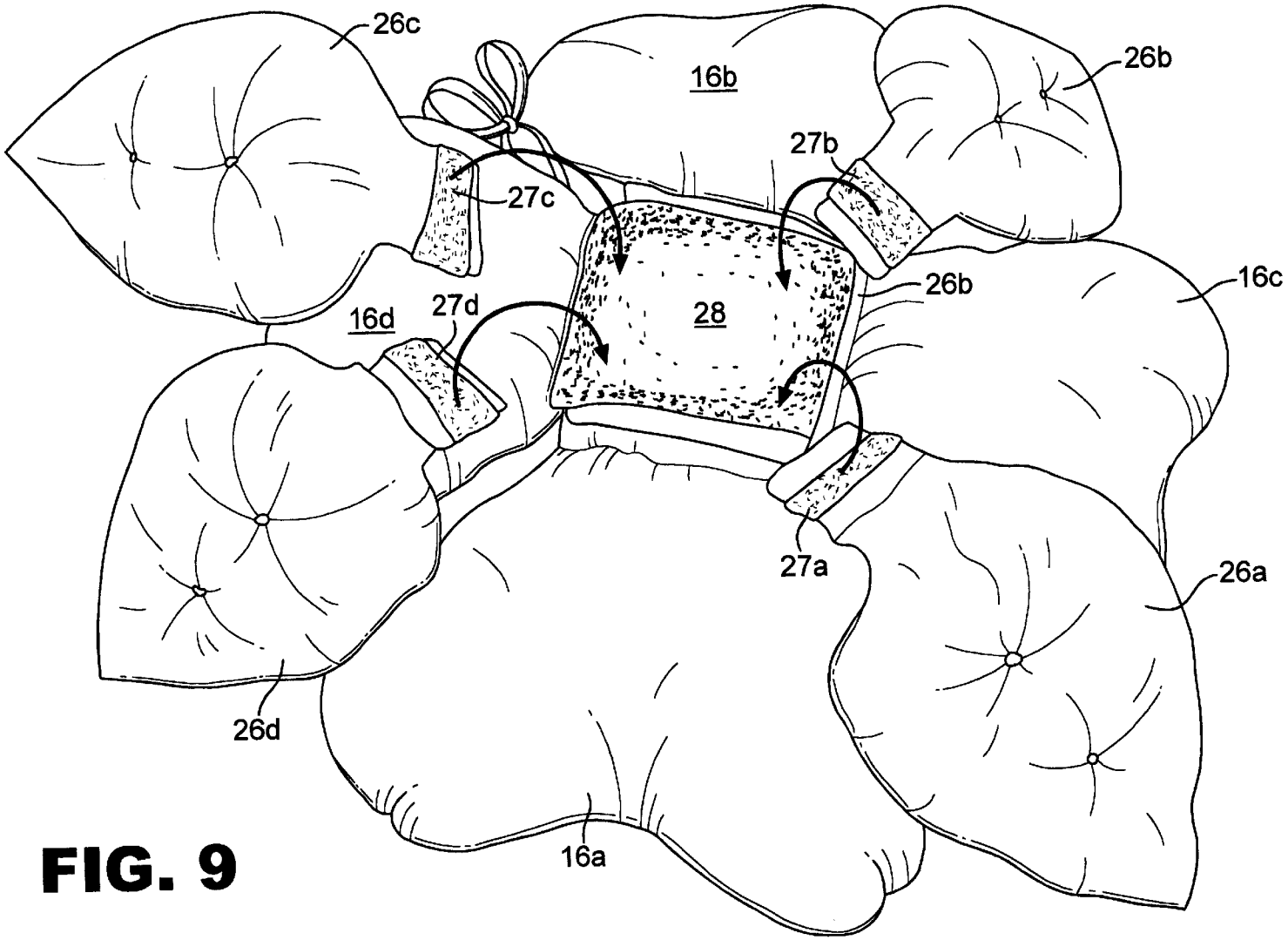
FIG. 9 is the view of FIG. 8 and further showing the manner of attaching the optional leaves accessory to the seat.
Figure 10:
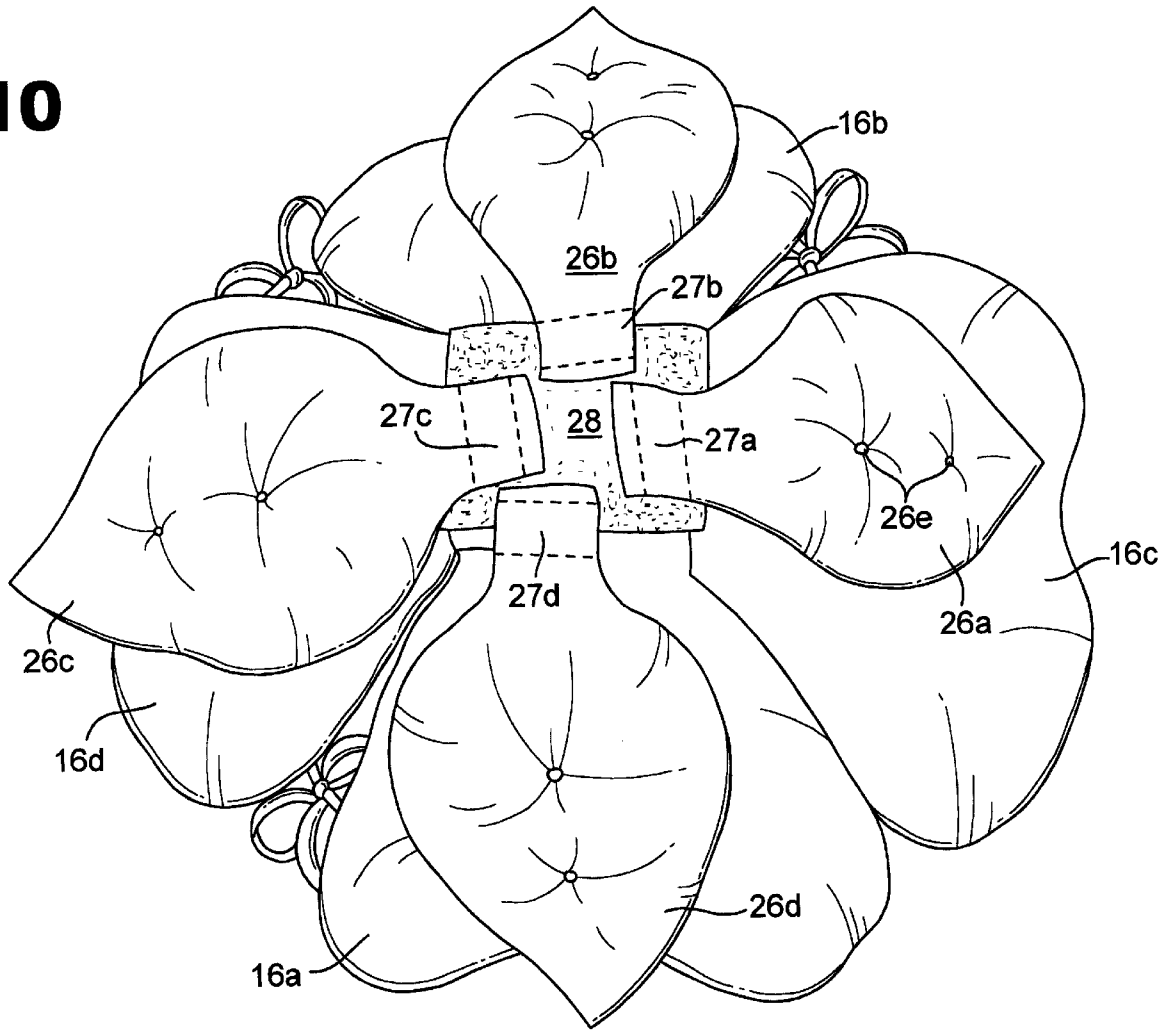
FIG. 10 is the view of FIG. 9 showing the leaves attached to the seat.

Referring to FIGS. 9 and 10, one or more decorative elements resembling leaves 26*a–d* may be removably attached to the lower surface 26*b* between side supports 16*c,* 16*d* using VELCRO patches 27*a–d* on leaves 26*a–d* and a mating VELCRO patch 28 on lower surface 26*b.* As seen In FIGS. 1 and 2, leaves 26*a–d* lie substantially flat on the floor, extending outwardly of side supports 16*a–d* such that they appear as natural leaves at the base of a flower which is represented by the side supports. In the preferred embodiment shown in the drawing, the leaves are made of a soft fabric and filled with a cushioning material such as foam or polyester, for example. If desired, the leaves may furthermore by tufted as at 26*e* for a more full, natural appearance. Although the leaves 26*a–d* as illustrated herein do not appreciably contribute to the stability of seat 10, nor is this feature deemed necessary in order for the seat 10 to adequately support an infant, the leaves may easily be made into auxiliary supporting elements if desired by incorporating a rigid or semi-rigid core into each of the leaves. With the leaves extending radially outwardly of the side supports and laying flat against the floor, it is evident that they could be used to add stability to the seat 10 in this way. Such rigid or semi-rigid elements may be of the type used in the garment or furniture manufacturing industries, for example, and would be covered with the cushioning inside the leaves so as to not pose an injury risk to the infant.

Other optional accessories for seat 10 include stuffed critters (e.g., butterflies, caterpillars, bees, mice, etc.) which may be either permanently or removably attached using VELCRO patches to various places on the seat, thereby encouraging the infant to use their visual, touch and motor skills when reaching for the stuffed critters. Sound stimulation may also be incorporated using rattles or crunchy paper incorporated into the stuffed critters.

It is of course understood that all materials and elements of the infant seat as manufactured will meet the applicable safety and regulatory requirements for such a product.

As stated above, the side supports 16*a–d* are used to support the infant while in seat 10. It is not intended that an infant ever be placed face down in seat 10, but rather have his/her buttocks laid down against pillow 18 with the adjacent side supports 16*a–d* providing support for the infant's back when necessary. It is of course necessary for the side supports 16*a–d* to be able to remain in the desired position while the infant is seated therein. A few ways in which this may be accomplished are illustrated in the Figures, although it is understood that there are a potentially infinite number of ways this may be accomplished as understood by those skilled in the art. As seen in FIGS. 2–10, each side support 16*a–d* may be provided with a pair of fabric ties 30,31 attached to opposite sides thereof with adjacent ties being tied together to secure the side supports in the manner seen in FIG. 2. The ties may be tied tight or lose to achieve the desired orientation. An alternate method of securing the side supports in the desired orientation is seen in FIG. 1 where a fabric belt 32 may be applied around the side supports and secured using VELCRO patches at the opposite ends thereof, for example, permitting the belt to be adjusted to the desired tightness. Tightening belt 32 will draw the side supports 16*a–d* further together and more upright while loosening belt 32 will allow the side supports to be moved outwardly toward the horizontal position to provide a more relaxed, "laid-back" orientation.

Figure 11:
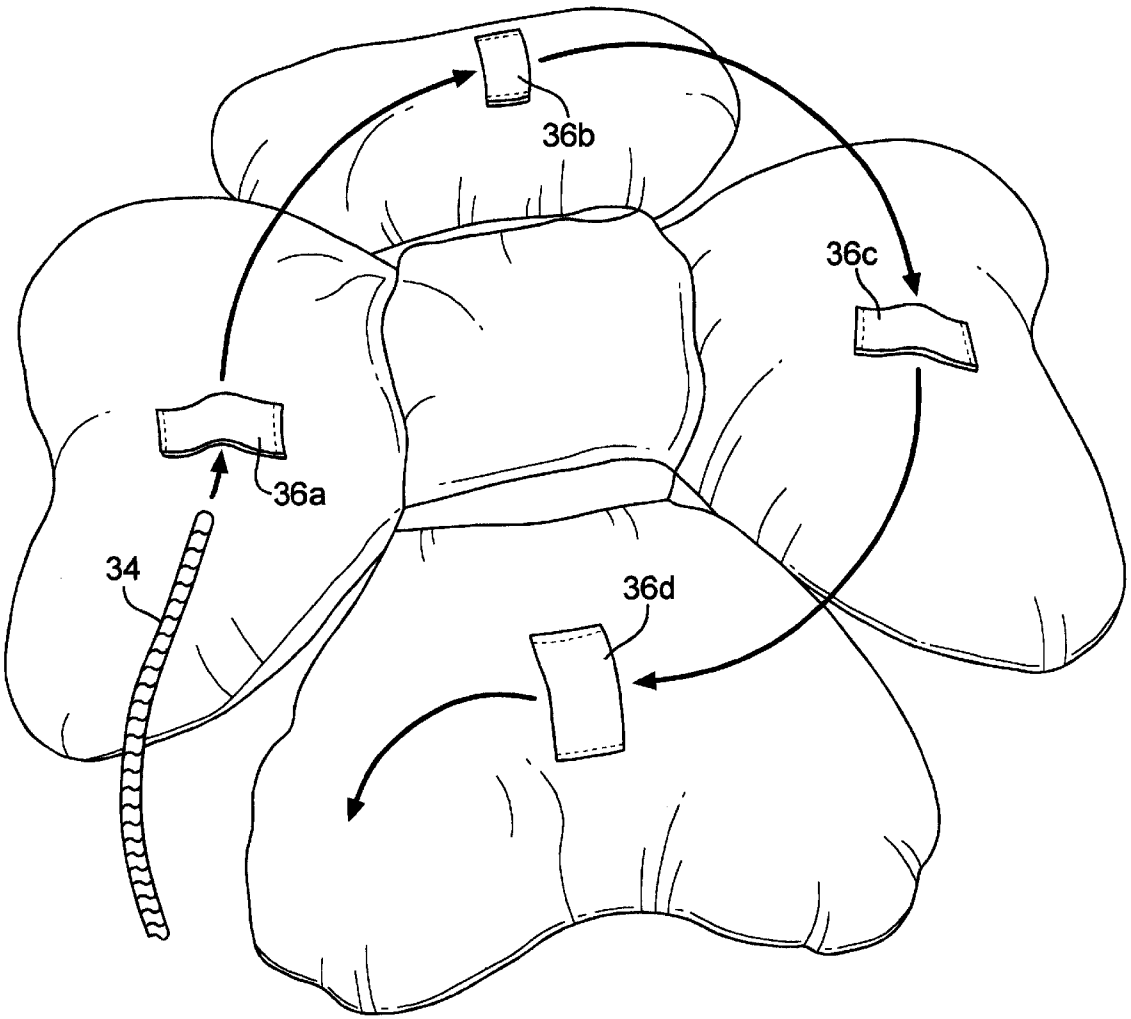
FIG. 11 is a bottom plan view of the seating structure showing an alternate method of connecting and adjusting the positions of the petals.

Yet another alternate method of securing the side supports in the desired orientation is seen in FIG. 11 where a length of rope 34 may be fed through loops 36*a–d* attached to the outwardly facing surfaces of each of the side supports 16*a–d,* respectively. The opposite ends of the rope may be tied or otherwise secured together and be adjustable in a manner similar to belt 32.

As discussed above, and seen in the figures, the side supports can be selectively and continuously adjusted between a horizontal position and a substantially vertical position.

Figure 12:
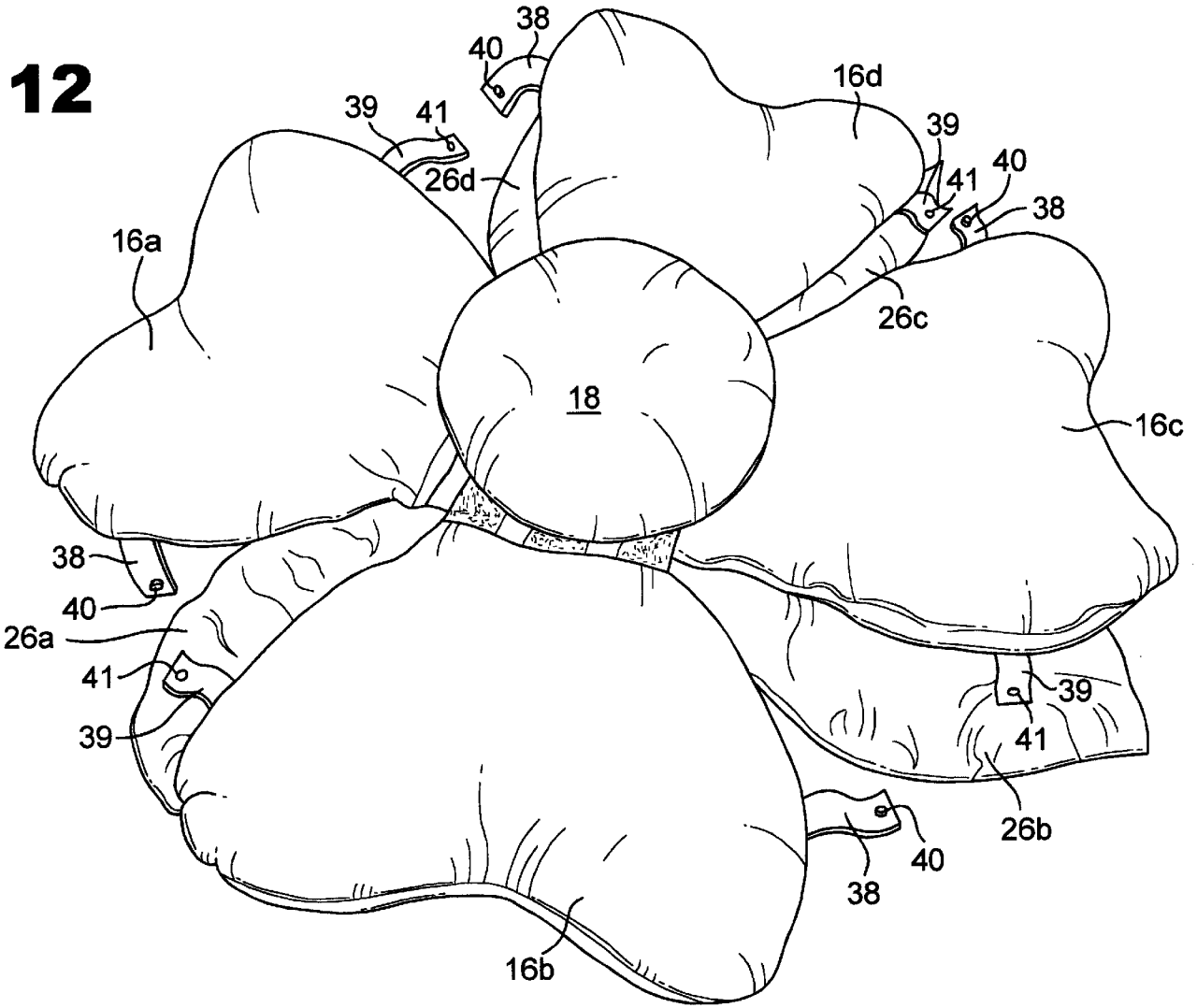
FIG. 12 is a top plan view of the seat showing yet another alternate method of connecting and adjusting the positions of the petals.
Figure 13:
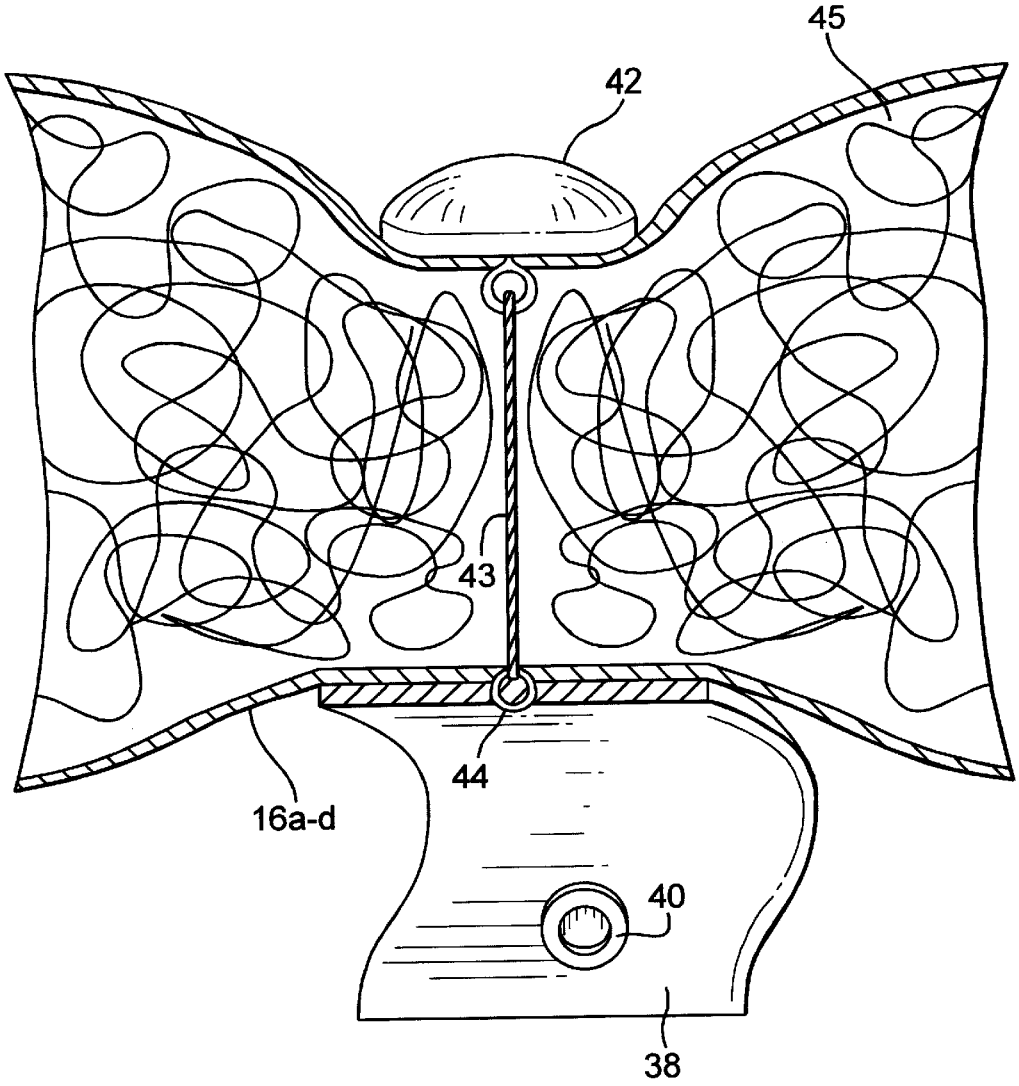
FIG. 13 is a cross-sectional view through a petal showing a method of tufting the petal and incorporating a petal connector in the form of a snap.

Still yet another alternate method of securing the side supports in the desired orientation is seen in FIG. 12 where a pair of fabric tabs 38,39 having snaps 40,41 thereon are attached to the opposite sides of each side support 16*a–d,* respectively. The tab on one side support is then snapped to the tab fixed on the adjoining side support to secure the side supports together. Adjustability may be provided using a plurality of different snap locations on each of the side supports (not shown). As seen in FIG. 13, each side support 16*a–b* may be tufted, if desired, by providing a button 42 and securing string 43 through the side support (and through the cushioning material 45 contained therein). The opposite end 44 of the securing string may also extend through fabric tab 38 to firmly secure the fabric tab 38 to the respective side support 16*a–d.*

It is thus evident that there are many different ways by which the side supports 16*a–d* may be secured and maintained in the desired orientation while also permitting each side support to be adjustable. Although not shown in the drawing, still another alternate method of securing the side supports in the desired orientation may be achieved by incorporating one or more rigid yet flexible elongated members into each of the side supports 16*a–d,* similar to that described with regard to leaves 26*a–d* above. The strength of the members would be sufficient to maintain the side support in the desired orientation taking into account the weight of an infant bearing thereagainst, yet also be able to be repeatedly bent back and forth without breaking upon an adult applying a stronger force thereto when it is desired to change the orientation of the side support.

Although a total of four side supports 16*a–d* are shown and described herein, it is understood that any number of side supports may be used as desired. It is also noted that adjacent side supports may overlap each other a bit, especially in the upright, vertical orientation, and that adjacent side supports may be manually adjusted (e.g., in the manner of "fluffing" a pillow) to achieve the desired orientation. Furthermore, it is possible to provide multiple layers or rows of side supports to achieve a fuller appearance of a flower such as a rose, for example.

It is also possible to form the side supports into one integral piece, although it is desirable to have the ability to adjust one part of the side support relative to another part of the side support. For example, with an infant that has more trouble tipping backward than he/she does tipping forward, it may be desirable to adjust the side support located directly in front of the infant to a more horizontal position, thus providing an enhanced range of movement for the infant in this forward facing direction (e.g., reaching and playing with toys directly in front of the infant), while the other side supports are oriented in a more vertical position to help stop the infant from tipping over backward or sideways. This feature would be provided using the embodiment described above where each of the side supports are individually provided with a rigid yet flexible member.

It will thus be apparent from the foregoing that the present invention provides a seat structure for an infant which solves the problems of prior seat structures which attempt to provide a support for a sitting infant which is comfortable and non-restrictive for the infant. While the inventive seat structure has been shown and described herein with regard to several preferred embodiments thereof, it is understood that still other modifications may be made thereto without departing from the full spirit and scope of the invention as is defined by the claims which follow.

I claim:

1. A seat for an infant comprising:

a) a plurality of side supports arranged in an endless array; and b) a center portion having a seating surface, said side support extending outwardly of said center portion;

wherein at least one of said side supports is selectively and continuously adjustable between a substantially horizontal position and a substantially vertical position.

2. The seat of claim 1, wherein each of said side supports is individually and selectively and continuously adjustable between a substantially horizontal position and a substantially vertical position.

3. The seat of claim 2 wherein said center portion comprises a pillow, and including a plurality of said side supports configured to resemble the petals of a flower.

4. The seat of claim 3, and further comprising one or more elements each configured to resemble a leaf, said elements being removably attached to said center portion opposite said seating surface.

5. The seat of claim 4 wherein said elements are adapted to stabilize said seat structure on a horizontal surface.

6. The seat of claim 3, and further comprising one or more stuffed toys removably attached to said side supports.

7. The seat of claim 1, wherein said side supports are secured with fabric ties fixed to each of said side supports.

8. The seat of claim 1 wherein said side supports are secured with an adjustable belt which surrounds said side supports.

9. The seat of claim 1 wherein said side supports are secured with adjustable mating snap elements fixed to said side supports.

10. The seat of claim 1 wherein said side supports are secured with a rigid yet flexible member incorporated into a respective said side support.

11. The seat of claim 1 wherein said side support and said center portion have a fabric outer covering filled with a cushioning material.

12. The seat of claim 1 wherein said fabric outer covering is removable from said cushioning material.

13. The seat of claim 1 wherein said array is in the shape of a circle.

14. The seat of claim 13 wherein a plurality of said side supports are provided and configured to resemble the petals of a flower.

15. An infant seat, comprising:

a) a plurality of side supports arranged in an endless array, said side supports configured to resemble the petals of a flower;

b) a center portion having a seating surface, said side supports extending outwardly from said center portion, wherein said side supports are individually movable and continuously adjustable between a substantially horizontal position and a substantially vertical position.

16. The seat of claim 15, wherein the adjustability of said side supports is provided by a rigid yet flexible member provided within each of said side supports.

17. The seat of claim 15 wherein said seat is formed from fabric coverings which are filled with a cushioning material.

18. A pet bed comprising:

a plurality of side supports arranged in an endless array and configured to resemble the petals of a flower; and a center portion having a seating surface upon which a pet may lie, said side supports extending outwardly of said center portion and arranged to substantially surround a pet laying therein, wherein said side supports are continuously adjustable between a substantially horizontal position and a substantially vertical position.

* * * * *